US007035572B2

(12) United States Patent
Vejtasa et al.

(10) Patent No.: US 7,035,572 B2
(45) Date of Patent: Apr. 25, 2006

(54) HARD IMAGING DEVICE CHARGING SYSTEMS, ELECTROPHOTOGRAPHY CHARGING SYSTEMS, HARD IMAGING APPARATUSES, AND HARD IMAGING DEVICE ELECTROPHOTOGRAPHY CHARGING METHODS

(75) Inventors: David S. Vejtasa, Springfield, MO (US); Omer Gila, Cupertino, CA (US); Gregory Ellis, Vancouver, WA (US); Thomas Camis, Boise, ID (US); Peter Gysling, New Plymouth, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 179 days.

(21) Appl. No.: 10/700,963

(22) Filed: Oct. 31, 2003

(65) Prior Publication Data

US 2005/0095035 A1 May 5, 2005

(51) Int. Cl.
*G03G 15/02* (2006.01)

(52) U.S. Cl. ..... 399/176; 399/159

(58) Field of Classification Search ..... 399/168, 399/176, 159; 361/212, 220, 221, 225
See application file for complete search history.

(56) References Cited

U.S. PATENT DOCUMENTS

| | | | | |
|---|---|---|---|---|
| 5,089,851 | A | 2/1992 | Tanaka et al. | |
| 5,146,280 | A | 9/1992 | Kisu | |
| 5,390,007 | A | 2/1995 | Kugoh et al. | |
| 5,444,519 | A | 8/1995 | Motoyama et al. | |
| 5,543,899 | A | 8/1996 | Inami et al. | |
| 5,596,393 | A | 1/1997 | Kobayashi et al. | |
| 5,666,608 | A | 9/1997 | Christensen | |
| 5,678,136 | A | 10/1997 | Watanabe et al. | |
| 5,751,801 | A | 5/1998 | Murata et al. | |
| 5,765,077 | A | 6/1998 | Sakurai et al. | |
| 5,805,962 | A * | 9/1998 | Ko | 361/225 |
| 5,819,142 | A | 10/1998 | Murata et al. | |
| 5,873,019 | A | 2/1999 | Mizuishi | |
| 5,956,553 | A | 9/1999 | Park | |
| 6,002,899 | A | 12/1999 | Stover et al. | |
| 6,014,529 | A * | 1/2000 | Sato | 399/176 |
| 6,041,209 | A | 3/2000 | Murata | |
| 6,064,841 | A | 5/2000 | Matsuzaki et al. | |
| 6,144,819 | A | 11/2000 | Nishiuwatoko | |
| 6,269,233 | B1 | 7/2001 | Yamaguchi | |
| 6,301,459 | B1 * | 10/2001 | Ishiyama et al. | |
| 6,405,006 | B1 | 6/2002 | Tabuchi | |

(Continued)

FOREIGN PATENT DOCUMENTS

JP 56091253 A * 7/1981

(Continued)

*Primary Examiner*—Susan Lee

(57) ABSTRACT

Aspects of the invention relate to hard imaging device charging systems, liquid electrophotography charging systems, hard imaging apparatuses, and hard imaging device electrophotography charging methods. In one embodiment, a hard imaging device charging system is described. The charging system may include a first charging device configured to charge a respective first region of a cylindrical image bearing member used to form latent images during hard imaging operations of the hard imaging device. The charging system may also include a second charging device configured to charge a respective second region of the cylindrical image bearing member used to form latent images during hard imaging operations of the hard imaging device. The first and second regions may have different radii from a central axis of the cylindrical image bearing member.

51 Claims, 9 Drawing Sheets

U.S. PATENT DOCUMENTS

| | | | | |
|---|---|---|---|---|
| 6,405,008 | B1 | 6/2002 | Obu et al. | |
| 6,546,219 | B1 | 4/2003 | Sato et al. | |
| 6,560,419 | B1 | 5/2003 | Sugiura | |
| 6,606,471 | B1 * | 8/2003 | Kamei et al. | 399/176 |
| 6,792,232 | B1 * | 9/2004 | Suzuki et al. | |
| 6,909,859 | B1 * | 6/2005 | Nakamura et al. | 399/176 |
| 2001/0033784 | A1 | 10/2001 | Becker et al. | |
| 2002/0154922 | A1 * | 10/2002 | Ohno et al. | 399/176 |

FOREIGN PATENT DOCUMENTS

| | | | | |
|---|---|---|---|---|
| JP | 56104346 | A | * | 8/1981 |
| JP | 63208877 | A | * | 8/1988 |
| JP | 04157485 | | | 5/1992 |
| JP | 05204228 | A | * | 8/1993 |
| JP | 05297681 | A | * | 11/1993 |
| JP | 06230648 | A | * | 8/1994 |
| JP | 2003167416 | | | 6/2003 |
| JP | 2003228225 | | | 8/2003 |

* cited by examiner $R2_a < R1_a$ $R2_b = R1_b$ $R2_c > R1_c$

HARD IMAGING DEVICE CHARGING SYSTEMS, ELECTROPHOTOGRAPHY CHARGING SYSTEMS, HARD IMAGING APPARATUSES, AND HARD IMAGING DEVICE ELECTROPHOTOGRAPHY CHARGING METHODS

FIELD OF THE INVENTION

Aspects of the invention relate to hard imaging device charging systems, liquid electrophotography charging systems, hard imaging apparatuses, and hard imaging device electrophotography charging methods.

BACKGROUND OF THE INVENTION

Charge rollers (CRs) are used to charge a photoconductor in hard imaging systems (e.g., laser-printer imaging systems). Similar to Scorotron/Corona charging, charge rollers use air ionization to charge a photoconductor. However, a charge roller has increased charging efficiency (close to 100% charging efficiency) and uses lower voltages (~1500V) compared with Scorotron charging (~6500V). Charge rollers are typically used in dry (e.g., toner-based) electrophotography processes. In liquid electrophotography processes using a photoconductor having a seam, charge rollers may create print quality defects due to accumulation of imaging fluid in defects or wrap-over sections (e.g., seam regions) on the photoconductor. Movement of the charge roller over a section of the photoconductor having an uneven layer of imaging fluid causes breakdown of the imaging fluid thereby depositing excess imaging oil on the photoconductor during each rotation of the charge roller. The extra imaging oil not only causes disturbance of normal imaging processes but also causes disruption of the Paschen curve and the photoconductor charging voltages, thereby leading to non-uniformity in charging and print quality defects.

Further, the charge roller interacts with the imaging oil and creates a sticky polymer that may coat the photoconductor. The above drawbacks may contribute to photoconductor quality issues by interfering with the photoconductor/blanket image transfer, interfering with image development, and interfering with cleaning of the photoconductor. The above drawbacks may also cause problems relating to photoconductor lateral conductivity, and uneven photoconductor charging. As a result, lifetime of consumables may decrease and the printing cost per page may increase. Furthermore, the created polymer is transferred to the photoconductor at distances corresponding to the circumference of the charge roller. For example, the charge roller during each rotation rolls some of the polymer onto the photoconductor, and the end result is a defect having a shape of the uneven imaging oil layer causing formation of images having decreasing intensities with increasing rotations of the charge roller. Improved imaging devices and methods are desired.

SUMMARY OF THE INVENTION

At least some embodiments of the invention relate to hard imaging device charging systems, liquid electrophotography charging systems, hard imaging apparatuses, and hard imaging device electrophotography charging methods.

In one aspect, a hard imaging device charging system is disclosed. The charging system may include a first charging device configured to charge a respective first region of a cylindrical image bearing member used to form latent images during hard imaging operations of the hard imaging device. The charging system may also include a second charging device configured to charge a respective second region of the cylindrical image bearing member used to form latent images during hard imaging operations of the hard imaging device. The first and second regions may have different radii from a central axis of the cylindrical image bearing member.

In another aspect, a hard imaging device electrophotography charging method is disclosed. The method includes charging a first region of a photoconductor using a first charging device, the photoconductor may be used to form latent images during hard imaging operations of the hard imaging device. The method may also include charging a second region of the photoconductor using a second charging device. The first charging may include charging an imaging region of the photoconductor of the hard imaging device, and the second charging may include charging a non-imaging region of the photoconductor.

Other aspects of the invention are disclosed herein as is apparent from the following description and figures.

DESCRIPTION OF THE DRAWINGS

FIGS. 7A–7C show exemplary configurations to provide clearances between primary and secondary charge rollers and the photoconductor, using active mechanisms according to various embodiments.

DETAILED DESCRIPTION OF THE INVENTION

Figure 1:
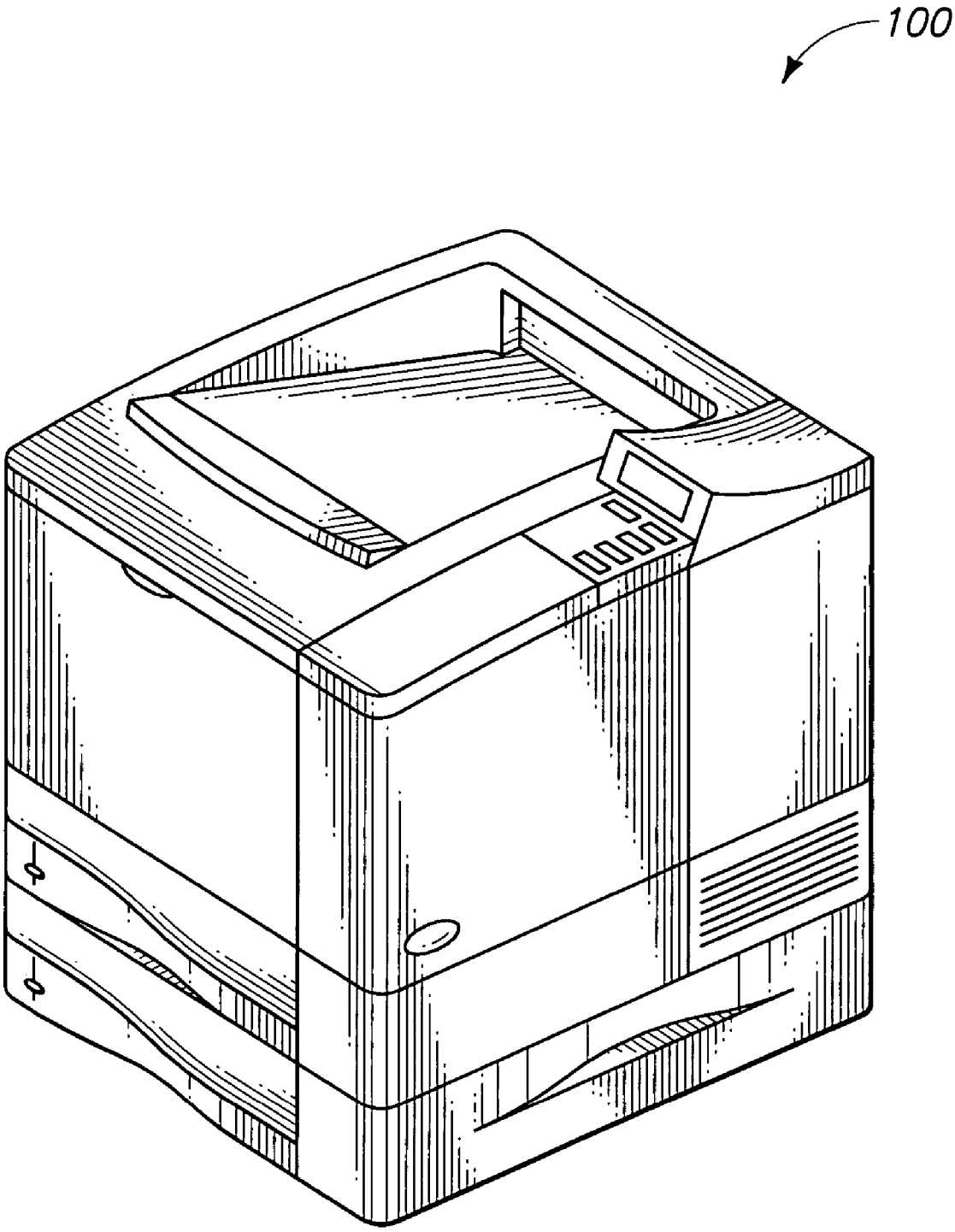
FIG. 1 is an exemplary diagram of a hard imaging device in accordance with one embodiment.

Referring to FIG. 1, an exemplary hard imaging device 100 is shown in accordance with one embodiment of the invention. The hard imaging device 100 may be a laser printer. Other configurations configured to form hard images upon a media 212 (FIG. 2) are possible, and include for example, multi-function peripherals, copiers, facsimile devices, etc. Hard imaging device 100 may be embodied as a device configured to use a dry or liquid marking agent (e.g., toner) in exemplary configurations.

Figure 2:
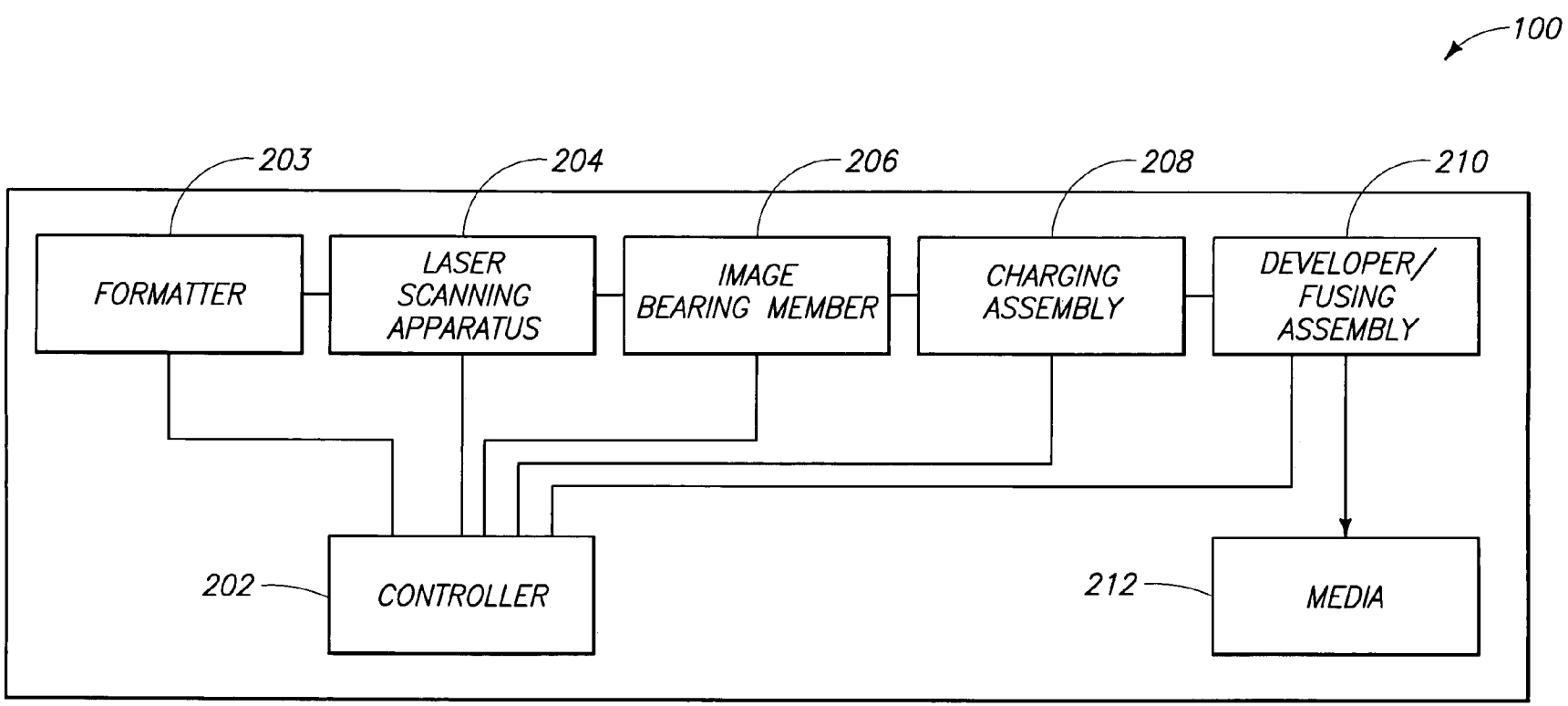
FIG. 2 is a high-level block diagram of a hard imaging device according to one embodiment.

FIG. 2 illustrates an exemplary high-level block diagram of the hard imaging device 100 in accordance with one embodiment of the invention. The depicted hard imaging device 100 configured as a laser printer includes a controller 202, a formatter 203, a laser scanning apparatus 204, an image bearing member (e.g., in one embodiment configured as a photoconductor) 206, a charging assembly 208, and a developer/fusing assembly 210 configured to form hard images on media 212.

The controller 202 may be configured to control operations of individual components (e.g., 203, 204, 206, 208, 210) of the hard imaging device 100. In one example, the controller 202 may be configured to control operations of the charging assembly 208. As described further below, exemplary operations of the charging assembly 208 include actuation/movement of primary and secondary charge rollers (e.g., reference numerals 402 and 404 of FIG. 4) of the charging assembly 208 in order to provide predetermined clearances between select charge rollers and the image bearing member 206. Further details of controller 202 are described below at FIG. 3.

Formatter 203 may be configured to perform image data processing operations (e.g., rasterization) of data received from an external source (not shown), internally generated, or otherwise accessed.

The laser scanning apparatus 204 may be configured to scan information formatted by the formatter 203 onto image bearing member 206 to form latent images. The laser scanning apparatus 204 may emit a light beam to scan information in one embodiment. The laser scanning apparatus 204 is alternatively referred to as a scanning device.

Image bearing member 206 includes a rotating imaging surface configured to receive information scanned by the laser scanning apparatus 204 in one embodiment. An exemplary image bearing member embodied as image bearing member 206 comprises a steel cylinder having an outwardly exposed layer of photoconductive material. Other embodiments of image bearing member 206 are possible. One or more lines of information (e.g., information formatted by the formatter 203) may be scanned by laser scanning apparatus 204 onto image bearing member 206 to form latent images on the imaging surface of the image bearing member 206 during hard imaging operations of the hard imaging device 100.

The charging assembly 208 may be configured to charge image bearing member 206 to enable forming of latent images on the image bearing member 206. In one embodiment, the charging assembly 208 may have a plurality of charging devices (e.g., a first charging device 402, a second charging device 404 (FIG. 4)). The charging assembly 208 is alternatively referred to herein as a charging system. First and second charging devices 402, 404 may also be referred to as charge rollers or members. Charge rollers 402, 404 are positioned adjacent to the image bearing member 206 to charge respective regions of the image bearing member 206 as described further below.

The developer/fusing assembly 210 may be configured to develop latent images formed on the image bearing member 206 using a marking agent (e.g., dry or liquid toner), and transfer and fuse the developed image to media 212 (e.g., hard-imaging media such as paper, transparencies, etc.).

Figure 3:
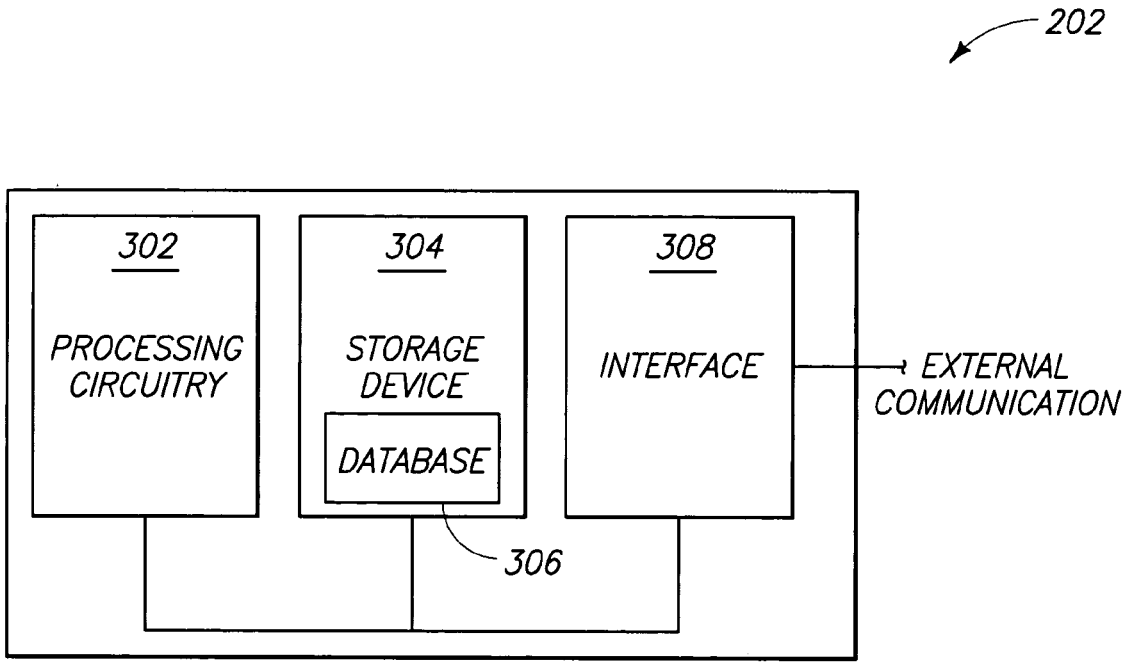
FIG. 3 is a functional block diagram of a controller of the hard imaging device according to one embodiment.

FIG. 3 is a functional block diagram of exemplary controller 202 configured to control operations (e.g., actuation/movement of charge rollers 402, 404 (FIG. 4)) of the charging assembly 208 or other components of device 100 in accordance with an exemplary embodiment. In one embodiment, the controller 202 includes processing circuitry 302, a storage device 304 having a database 306, and an interface 308. Other implementations of the controller 202 are possible.

Processing circuitry 302 may be configured in one embodiment to issue command signals to an actuator 510 (FIG. 7A) to control movement of one or both of primary and secondary charge rollers 402, 404 (FIG. 7A), respectively, to provide predetermined clearances (e.g., charging clearance, spaced clearance) between image bearing member 206 and charge rollers 402, 404 (FIG. 7A), respectively. For example, processing circuitry 302 may be configured to issue command signals to actuator 510 (FIG. 7A) to control movement of the primary and/or secondary charge rollers 402, 404 (FIG. 7A), respectively, to provide predetermined clearances with respect to different regions or areas of the image bearing member 206.

In one embodiment, processing circuitry 302 may comprise circuitry configured to execute provided programming. For example, processing circuitry 302 may be implemented as a microprocessor or other structure configured to execute executable instructions of programming including, for example, software and/or firmware instructions. Other exemplary embodiments of processing circuitry 302 include hardware logic, PGA, FPGA, ASIC, and/or other structures. These examples of processing circuitry 302 are for illustration and other configurations are possible for implementing operations discussed herein.

The storage device 304 may be configured to store predetermined value(s) corresponding to clearances between primary charge roller 402, secondary charge roller 404, and image bearing member 206, respectively. The predetermined clearance value(s) may be stored in database 306 of the storage device 304. For example, the predetermined value(s) may be stored in the form of a table in the database 306 of the storage device 304, and the stored information may be configured for retrieval by the processing circuitry 302.

The storage device 304 may also be configured to store electronic data, file systems having one or more electronic files, programming such as executable instructions (e.g., software and/or firmware for use by processing circuitry 302), and/or other digital information and may include processor-usable media. Processor-usable media includes any article of manufacture which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

Interface 308 may be configured to communicate electronic data externally of the controller 202, for example, received from external devices, with formatter 203 to perform rasterization tasks, and communicate control signals to an actuator 510 (FIG. 7A) to control movement of charge rollers 402, 404 (FIG. 7A).

Figure 4:
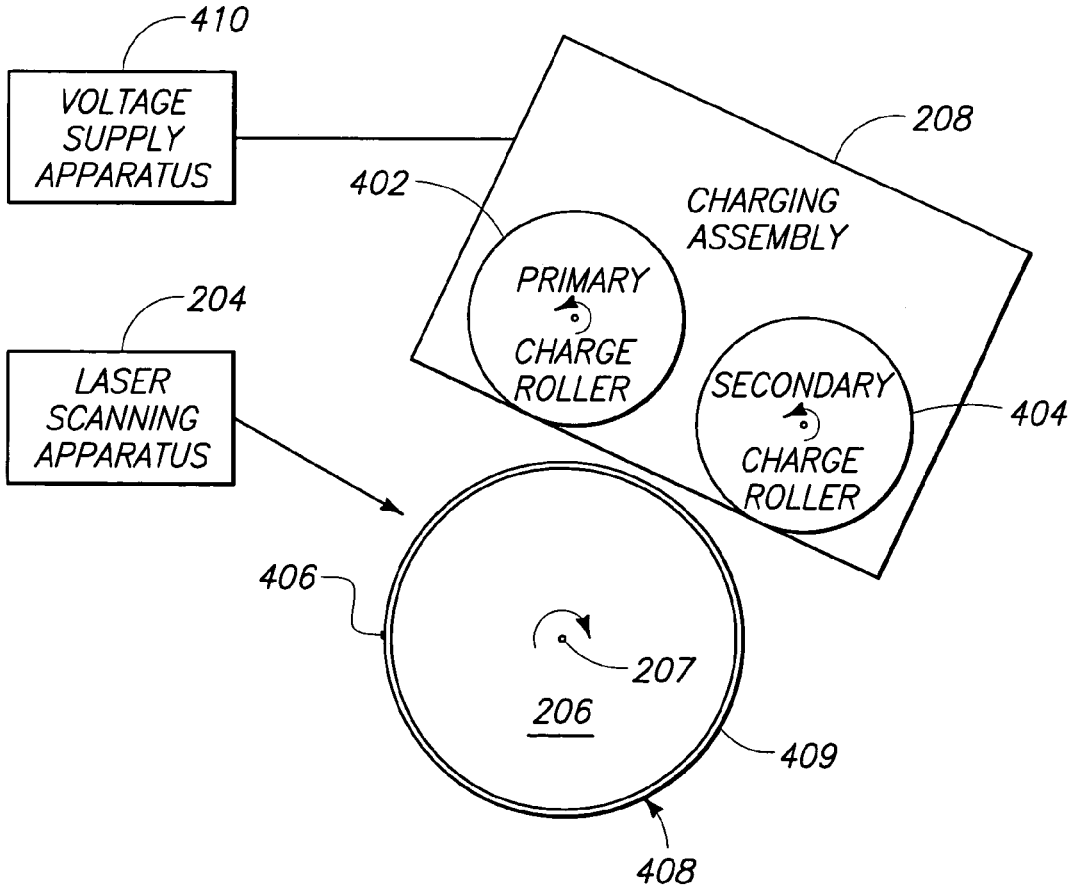
FIG. 4 is a functional schematic illustrating an exemplary electrophotographic process according to one embodiment.

FIG. 4 is a functional schematic illustrating exemplary electrophotography aspects. For example, charging of a image bearing member 206 using a charging assembly 208 in accordance with one embodiment is shown. The charging assembly 208 is positioned adjacent to the image bearing member 206 in order to charge respective plural regions of the image bearing member 206. The charging assembly 208 includes primary and secondary charge rollers 402, 404 to charge respective regions of the image bearing member 206.

A voltage supply apparatus 410 is configured to supply voltage to the charging assembly 208 (e.g., primary and secondary charge rollers 402, 404, respectively) to charge respective regions of the image bearing member 206.

As discussed further below, image bearing member 206 comprises a plurality of different regions. The plural regions may correspond to regions of an outer surface of image bearing member 206 having different radii or otherwise spaced different distances from a central axis 207. For example, image bearing member 206 may comprise first and second regions/areas 408, 406 of different radii. In one embodiment, photoconductive material of image bearing member 206 may be provided in a layer 409 about a cylinder. The layer 409 may be joined at a seam region or area. In one example, a second region 406 corresponds to the seam area created during wrapping of imaging or photoconductive material 409 on the cylindrical drum to form the image bearing member 206. A first region 408 corresponds to an area other than the region 406 of the image bearing member 206. In one embodiment, region 408 of the image bearing member 206 is configured to form latent images during hard imaging operations of the hard imaging device 100 (FIG. 1) and may be referred to as an image area or region. In one embodiment, it may be desired that the second region 406 not be used to form latent images. However, it may be desirable to charge region 406 in such an arrangement to prevent the development thereof with a marking agent. Other embodiments are possible.

In one embodiment, roller 402 only charges region 408 and roller 404 only charges region 406. In order to charge region 408 of the image bearing member 206, the primary charge roller 402 may be configured to contact region 408 of the image bearing member 206 in one embodiment or maintain a clearance (e.g., 19 microns or less) with region 408 of the image bearing member 206 according to another embodiment while still providing charging. A position for charging using rollers 402 or 404 may be referred to as a charging position and may include spaced clearance or actual contact of the roller with the respective region of the image bearing member 206. The primary charge roller 402 may be configured to maintain a desired clearance (e.g., greater than 200 microns) with region 406 of the image bearing member 206 in order to avoid charging of region 406. A position used to avoid charging may be referred to as an insulation or insulating position.

In order to charge region 406 of the image bearing member 206, the secondary charge roller 404 may be may be provided in the charging position relative to region 406. The secondary charge roller 404 may be provided in an insulation position with respect to region 408 in order to avoid charging of region 408.

Figure 4A:
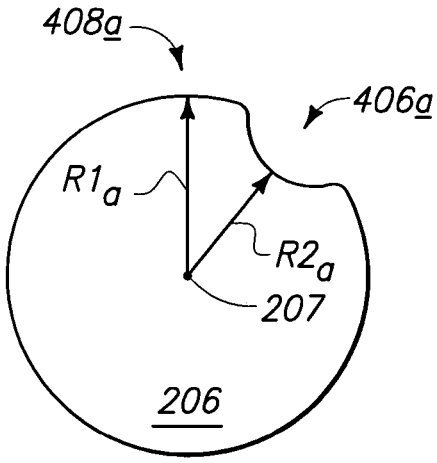
FIGS. 4A–4C shows exemplary schematics illustrating arrangements of a photoconductor according to various embodiments.
Figure 4B:
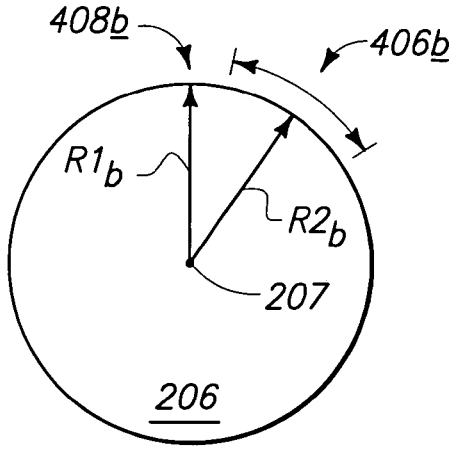
Figure 4C:
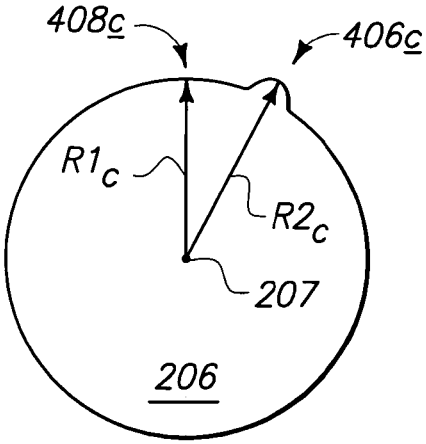

FIGS. 4A–4C shows exemplary schematics illustrating arrangements of region 406 with respect to region 408 of image bearing member 206 according to various embodiments. In these embodiments, like elements are identified with like numerals, but with a suffix added. FIG. 4A illustrates an exemplary arrangement having region 406*a* having a reduced radius ($R2_a$) compared to radius ($R1_a$) of region 408*a* (e.g., region 406*a* arranged at a lower level compared to region 408*a* on image bearing member 206 ($R2_a<R1_a$)). FIG. 4B illustrates an exemplary arrangement having region 406*b* having a similar radius ($R2_b$) compared to radius ($R1_b$) of region 408*b* (e.g., areas 406 and 408 are arranged on a same level on the image bearing member 206 ($R2_b=R1_b$)). FIG. 4C illustrates an exemplary arrangement having region 406*c* having a larger radius ($R2_c$) compared to radius ($R1_c$) of region 408*c* (e.g., region 406 is arranged at a higher level compared to region 408 on image bearing member 206 ($R2_c>R1_c$)). A given region 406 or 408 may or may not have a constant radius throughout an entire respective region in the described embodiments.

Figure 5A:
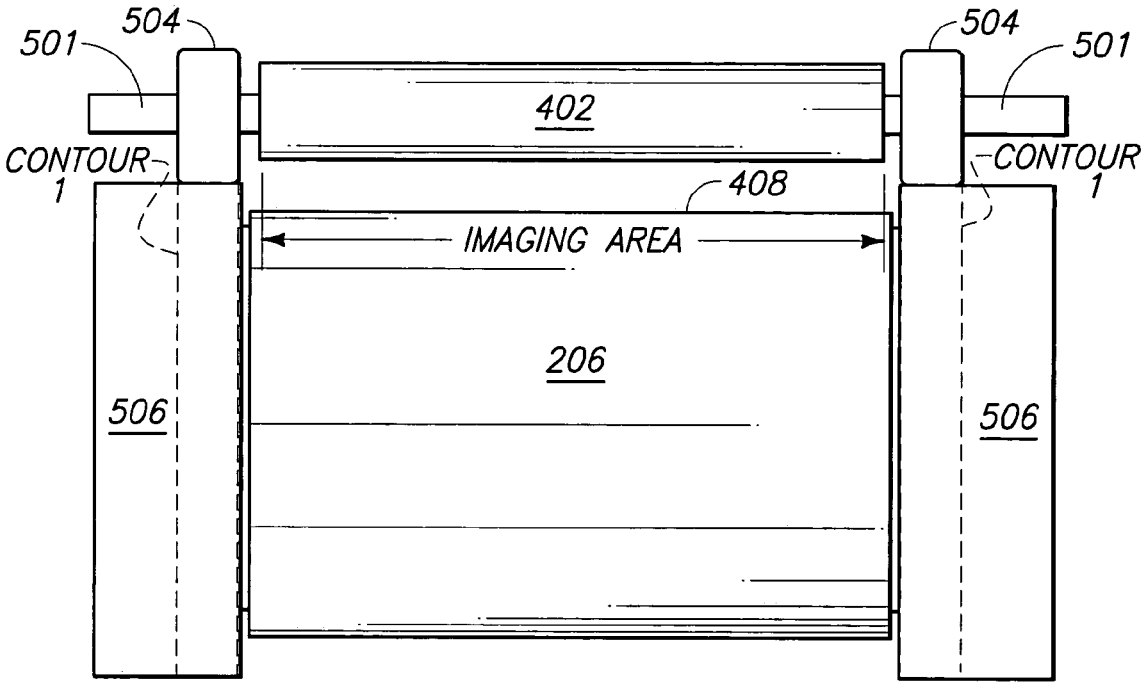
FIGS. 5A–5B show exemplary configurations to provide clearances between primary and secondary charge rollers and the photoconductor, using passive mechanisms according to various embodiments.
Figure 5B:
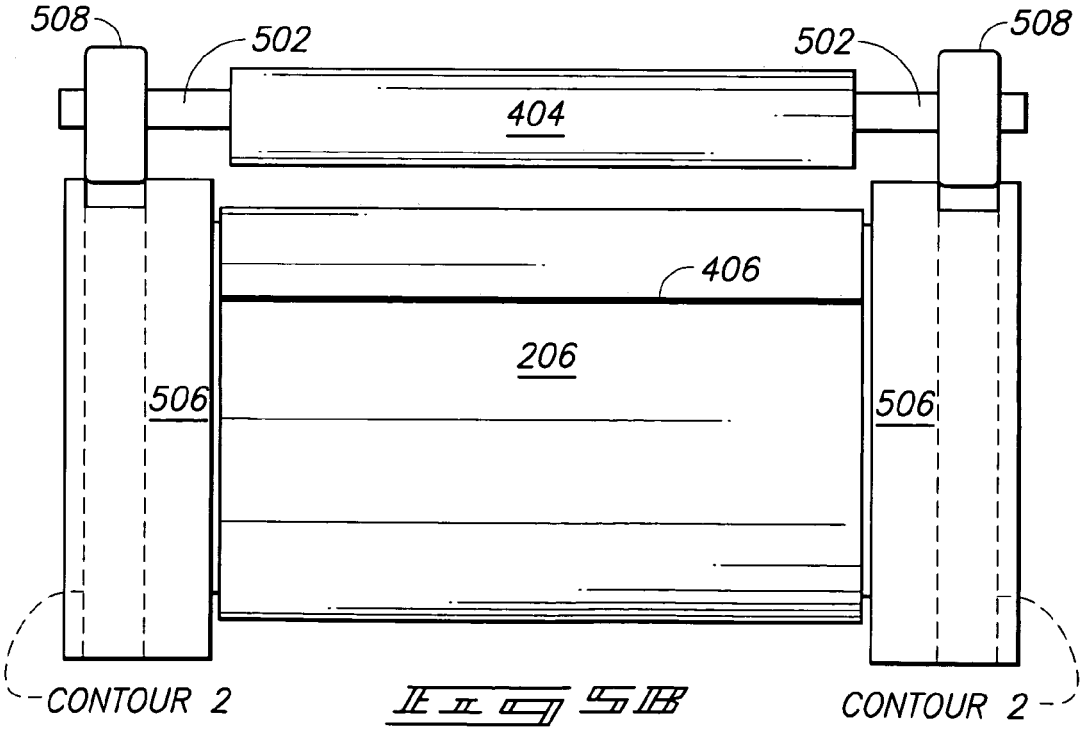

FIGS. 5A–5B show exemplary arrangements schematics to provide predetermined positions (e.g., charging or insulation positions) of rollers 402, 404, with respect to respective areas 408, 406 using passive or passively controlled mechanisms (e.g., drive rollers, reference disks) to provide charging of respective areas 408, 406 by only respective rollers 402, 404. Passively controlled may refer to controlling positions between charge rollers 402, 404 and respective regions 408, 406 of image bearing member 206 using passive mechanisms such as drive rollers (e.g., 504, 508), reference disks 506, etc. Passive mechanisms may refer to configurations not relying upon control from provided processing circuitry or other external control.

In one embodiment as mentioned above, roller 402 only charges region 408 and roller 404 only charges region 406. For example, the primary and secondary charge rollers 402, 404, respectively, may be individually provided within the charging positions with respect to areas 408, 406 of the image bearing member 206 to provide appropriate charging.

Referring now to FIG. 5A, the primary charge roller 402 includes end portions 501 of a cylindrical shaft configured to be received by drive members 504 (e.g., drive rollers), and drive members 504 are configured to roll on a respective contour path (e.g., contour 1 of FIG. 6A) of members 506 (e.g., reference disks) of the image bearing member 206 in order to provide predetermined charging and insulated positioning of primary charge roller 402 with respect to areas 408, 406, respectively.

Referring now to FIG. 5B, end portions 502 of a cylindrical shaft of the secondary charge roller 404 are received in drive members 508 (e.g., drive rollers), and members 508 are configured to roll on a respective contour path (e.g., contour 2 of FIG. 6A) of members 506 (e.g., reference disks) of the image bearing member 206 to provide predetermined charging and insulated positioning of secondary charge roller 404 with respect to areas 408, 406, respectively. In the illustrated embodiment, drive members 508 may be positioned offset relative to drive members 504 in order to follow different respective contour paths on a surface of members 506. As shown, each set of drive members 504, 508, respectively, may be configured to ride on a distinct section (e.g., contour 1, contour 2) of a surface of members 506 of the image bearing member 206 to provide desired charging or insulated positioning during charging of the image bearing member 206. Contours 1 and 2 illustrated in FIGS. 5A–5B are shown to be merely exemplary. Other contour arrangements to maintain clearances between charge rollers 402, 404 and respective areas of image bearing member are possible.

Accordingly, in one embodiment, passive mechanisms (e.g., drive rollers 504, 508, members 506) may be configured to selectively control the first and second charge rollers 402, 404 (FIG. 4) corresponding to rotation of regions 408, 406 (FIG. 4) of the image bearing member 206 during rotation of the image bearing member 206 and member 506 therewith.

Figure 6A:
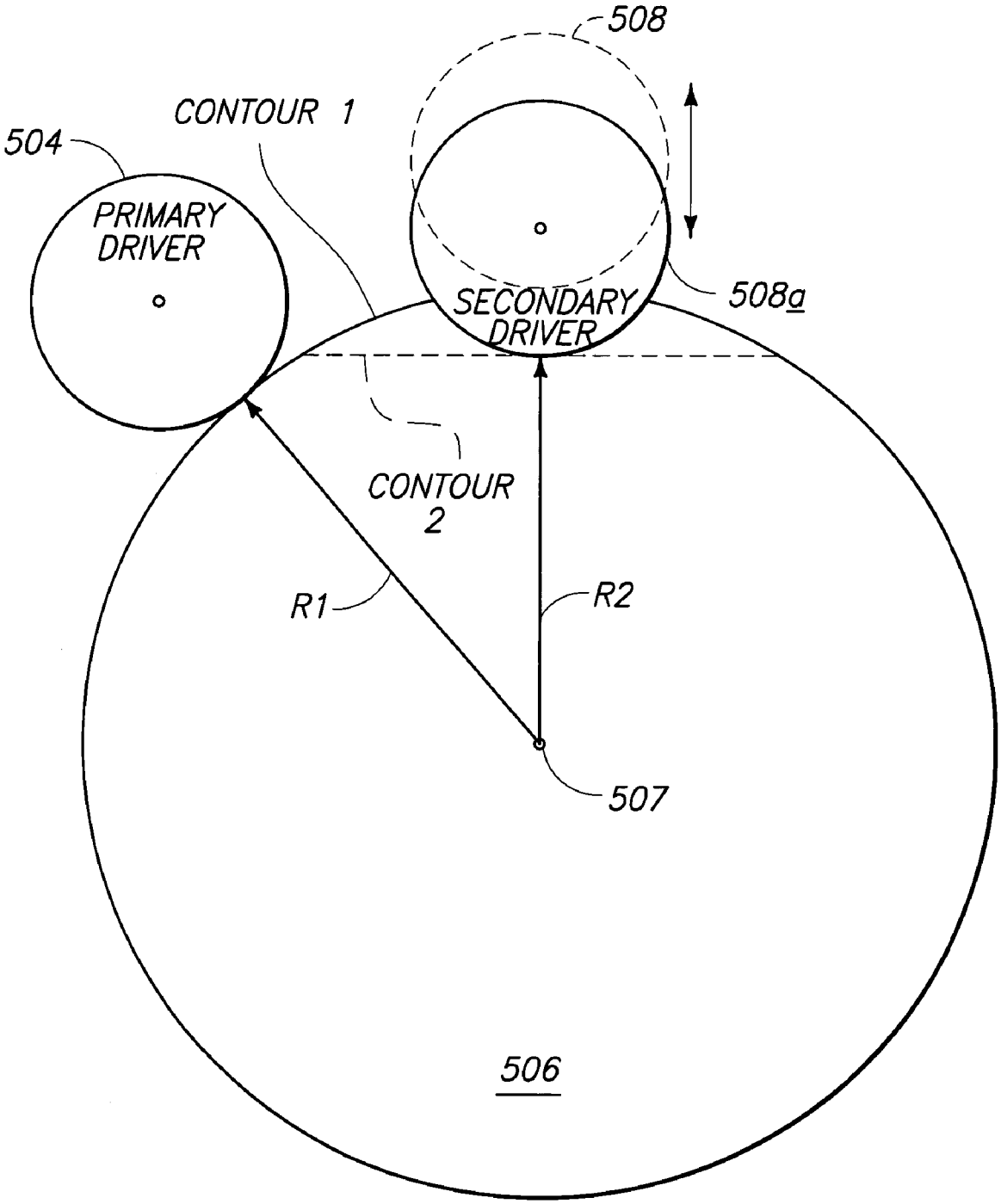
FIGS. 6A–6B are side view schematics for providing predetermined clearances between primary and secondary charge rollers and the photoconductor according to various embodiments.
Figure 6B:
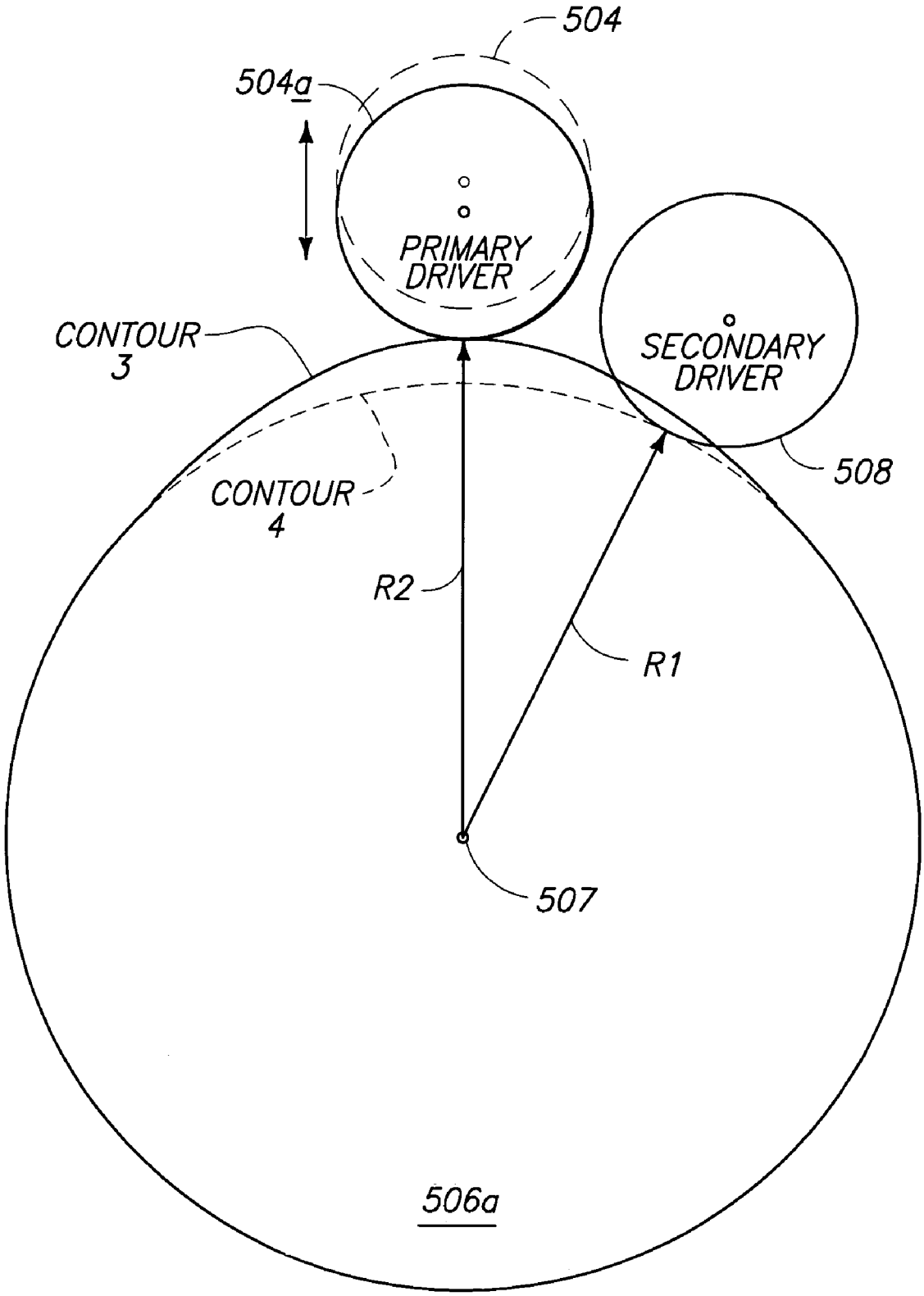
Figure 11:
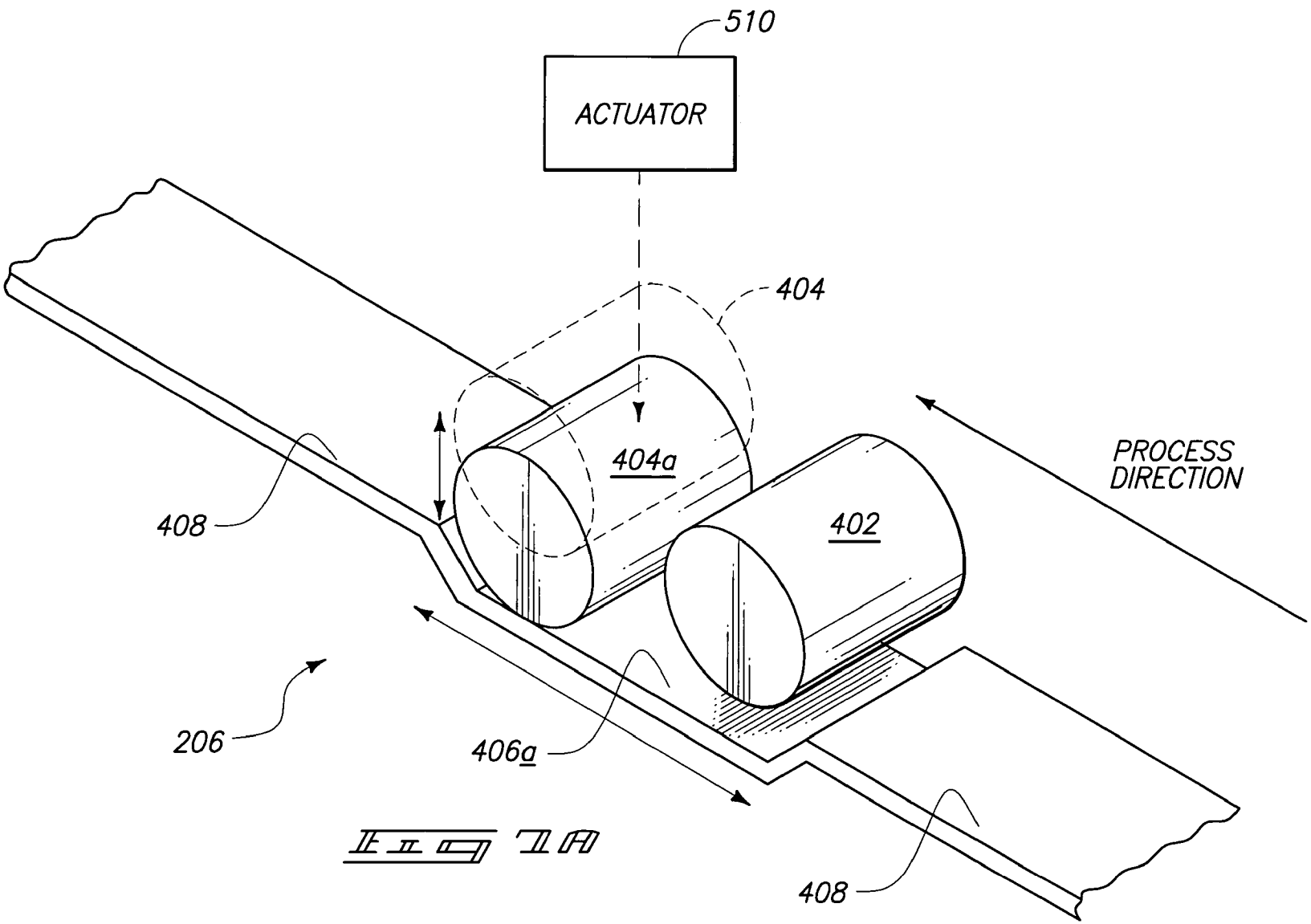

FIGS. 6A–6B show side view schematics for providing predetermined clearances between primary and secondary charge rollers 402, 404 and image bearing member 206 in order to only charge respective regions (e.g., 408, 406) of the image bearing member 206 according to exemplary embodiments.

FIG. 6A illustrates positioning of drive members 504, 508 on surfaces of members 506 of image bearing member 206 in order to provide predetermined positioning of charge rollers 402, 404 and image bearing member 206 in order to only charge areas 408, 406, respectively, of the image bearing member 206 of FIG. 4A. In the exemplary embodiment of FIG. 6A, region 406*a* has reduced radii $R2_a$ compared to region 408*a* having radius $R1_a$ (FIG. 4A).

In one embodiment as described above, members 506 may be configured via varied contour paths to enable the primary charge roller 402 to charge only region 408 of the image bearing member 206. Members 506 may also be configured to enable the secondary charge roller 404 to charge only region 406 of the image bearing member 206.

In the exemplary illustration of FIG. 6A, drive member 504 may be configured to follow contour 1 (e.g., a first section of a surface of member 506) to charge only region 408 while drive member 508 may be configured to follow contour 2 (e.g., a second section of a surface of member 506) to enable the secondary charge roller 404 to charge only region 408 of the image bearing member 206 (FIG. 4). Contour 2 of member 506 has a reduced radius R2 at region 406 of image bearing member 206 than radius R1 of contour 1, the radii being measured from a central axis 507 to respective contour surfaces of member 506. Drive member 508 may be configured to move the secondary charge roller 404 (FIG. 4) to depicted position 508*a* to charge region 406 at the depicted position 508*a*. At the illustrated position of member 508, roller 404 is provided at an insulation position with respect to region 408. Contour 1 corresponding to a circular circumference of member 506 provides roller 402 in the charging position relative to region 408 and in the insulating position relative to region 406.

Referring to FIG. 6B where like components are identified using like numerals, region 406 is arranged having a larger radius when compared to region 408 of the image bearing member 206 (FIG. 4C).

In the exemplary illustration of FIG. 6B, drive member 504 may be configured to follow contour 3 (e.g., a first section of a surface of member 506*a*) to enable the primary charge roller 402 to only charge region 408. Drive member 508 may be configured to follow contour 4 (e.g., a second section of a surface of member 506*a*) to enable the secondary charge roller 404 to only charge region 406 of the image bearing member 206. In the exemplary embodiment of FIG. 6B, region 406 has a larger radius $R2_c$ compared to region 408 having radius $R1_c$. Contour 3 of member 506 has larger radii R2 at region 406 of image bearing member 206 than radius R1 of contour 4, the radii measured from a central axis 507 to respective contour surfaces of member 506. Drive member 506 may be configured to move the secondary charge roller 404 from a charging position 504*a* for charging region 408 to the insulated position 504 with respect to region 406. Member 508 does not move in a radial direction in the configuration of FIG. 6B but is located to provide roller 404 in an insulated position with respect to region 408 and a charging position with respect to region 406. In a configuration corresponding to FIG. 4B (i.e., equal radius for regions 406, 408), member 506*a* may be altered to provide contour 4 of FIG. 6B as contour 2 to provide inward radial movement of roller 404 to selectively charge region 406 and move to the insulated position to not charge region 408. The indent (e.g., shown in contour 2 of FIG. 6A) may be aligned with the increased radius of contour 3 along the circumference of member 506*a*.

Accordingly, size (e.g., diameter) of the drive members 504, 508 may be varied to provide predetermined positioning of rollers 402, 404 with respect to regions 408, 406. In another embodiment, positions of members 506 of the image bearing member 206 are desired to be of circular shape as other processes (e.g., developing, fixing, etc.) of the hard imaging device 100 (FIG. 1) may rely on the image bearing member 206 for precision spacing. Accordingly, one portion of members 506 may be circular for other processes, and another contoured of different radii to control positioning of rollers 402, 404.

Figure 7B:
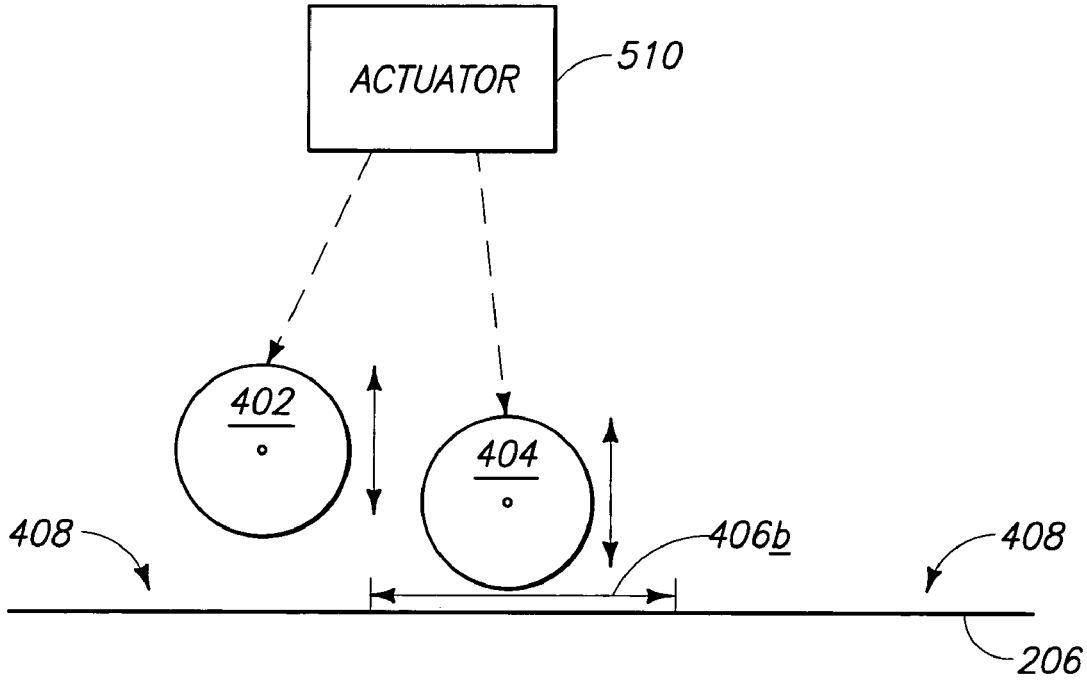
Figure 7C:
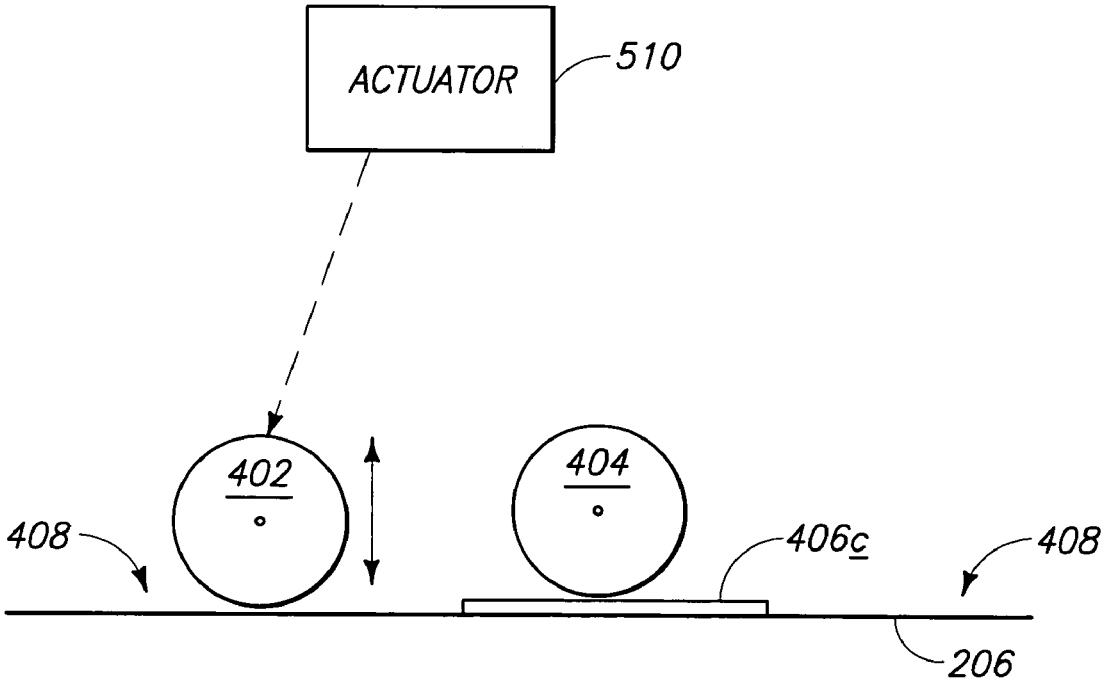

FIGS. 7A–7C show exemplary schematics to control positioning of primary charge roller 402 and secondary charge roller 404 with respect to regions 408, 406 using actively controlled mechanisms (e.g., solenoid driven actuators, stepper motor, or such external load systems, etc.) in accordance with various embodiments. For example, actively controlled is generally defined as controlling positioning of charge rollers 402, 404 using actively controlled mechanisms as motors, solenoid actuators, etc.

Referring to FIG. 7A, there is shown an exemplary schematic to charge areas 408, 406, respectively, of image bearing member 206 using primary and secondary charge rollers 402, 404, respectively, in accordance with one embodiment. Image bearing member 206 is configured to rotate in the indicated process direction in the depicted embodiment. Desired positioning of rollers 402, 404 is provided by selectively moving one or both of primary and secondary charge rollers 402, 404, using one or more actuator 510 (only movement of roller 404 is shown in FIG. 7A).

In the exemplary embodiment of FIG. 7A, a single actuator 510 is shown to control movement of charge roller 404. In one example, actuator 510 may be a solenoid control actuator having a motor to move charge roller 404 (or roller 402) into desired positions. In another example, a spring-loaded mechanism (not shown) may be provided to enable movement of one or both of charge rollers 402, 404 towards or away from the image bearing member 206. The spring-loaded mechanism may be coupled to the actuator 510 to establish desired positioning.

Continuing to refer to the exemplary embodiment shown in FIG. 7A, area 406*a* of image bearing member 206 is provided at a reduced radius compared to a radius of region 408 of image bearing member 206. Actuator 510 may be configured such that roller 404 is moved to a position 404*a* to only charge region 406*a* while the charge roller 402 is provided at a fixed position to charge only region 408 and to avoid charging region 406*a*. The actuator 510 may be configured to lower (e.g., move towards the image bearing member 206) the secondary charge roller 404 to charge region 406 at the depicted position 404*a*.

Processing circuitry 302 (FIG. 3) of controller 202 (FIG. 3) may be configured to issue command signals to actuator 510 to control movement (e.g., towards or away from the image bearing member 206) of the secondary charge roller 404. The processing circuitry 302 (FIG. 3) may be configured to issue timing signals to actuator 510 to appropriately time such movement of the charge roller 404. For example, processing circuitry 302 (FIG. 3) may be configured to monitor rotation of image bearing member 206 and issue command signals to actuator 510 to lower or raise the secondary charge roller 404 (or roller 402) as appropriate.

FIG. 7B shows an exemplary schematic for charging image bearing member 206 having areas 408, 406*b* arranged at a same level (e.g., spaced at substantially constant radius of FIG. 4B) on the image bearing member 206 in accordance with an exemplary embodiment. Actuator 510 may be configured to move both primary and secondary charge rollers 402, 404 to charge only respective areas 408, 406 of the image bearing member 206.

In one example, primary charge roller 402 is controlled to charge region 408 and be insulated from charging of region 406. The secondary charge roller 404 may be configured to charge region 406 and be insulated from region 408. Movement of charge rollers 402, 404 to charge areas 408, 406, respectively, may be controlled using actuator 510 responsive to control of processing circuitry 302 in one embodiment.

FIG. 7C shows an exemplary schematic for charging image bearing member 206 having region 406 arranged at a higher level (e.g., increased radius as shown in FIG. 4C) when compared to region 408 on the image bearing member 206, according to one embodiment. In this exemplary embodiment, charging of areas 408, 406 of the image bearing member 206 may be performed by arranging the secondary charge roller 404 to charge region 406 while be insulated from region 408. Roller 404 may be provided at fixed or moveable positions in exemplary embodiments. Roller 402 may be controlled to move between the charging and insulated positions to charge only region 402 in one embodiment.

Processing circuitry 302 may be configured to issue command signals to actuator 510 to control movement of primary and/or secondary rollers 402, 404, respectively, as described above (e.g., responsive to monitoring rotation of image bearing member 206) or using other control.

Exemplary advantages of some embodiments include providing a clearance between charge rollers and an image bearing member to reduce chances of damage to the charge rollers due to contact with the image bearing member. Since no direct charging of the image bearing member occurs in embodiments having a clearance between the charge rollers and the image bearing member, high charging uniformity in both in-scan and cross-scan directions may be possible. Solutions provided by some embodiments provide a charging system which is more robust to misalignments and material defects during manufacturing. Other advantages of using charge rollers to charge a image bearing member include efficiencies related to cost, size, and Ozone generation rate.

As described herein, some exemplary hard imaging device embodiments utilize image bearing members having a seam area. For hard imaging devices comprising liquid electrophotography systems, it may be desired to charge the seam area to prevent or reduce ink development in the seam area. Usage of a plurality of charge rollers, one dedicated to charge the seam area as described in some embodiments herein, facilitates filtering of contamination materials, such as imaging oil, and reduces the introduction of the contamination materials into the image area of the image bearing member.

The protection sought is not to be limited to the disclosed embodiments, which are given by way of example only, but instead is to be limited only by the scope of the appended claims.

What is claimed is:

1. A hard imaging device charging system comprising:

a first charging device configured to charge a respective first region of a cylindrical image bearing member used to form latent images during hard imaging operations of the hard imaging device; and a second charging device configured to charge a respective second region of the cylindrical image bearing member used to form latent images during hard imaging operations of the hard imaging device, and wherein the first region and the second region comprise different radii from a central axis of the cylindrical image bearing member.

2. The system of claim 1, further comprising:

a mechanism for selectively controlling positioning of at least one of the first and second charging devices with respect to the image bearing member.

3. The system of claim 2, wherein the mechanism is configured to passively control the positioning without an external control.

4. The system of claim 2, wherein the mechanism is configured to be actively controlled to control the positioning responsive to monitoring of a position of the image bearing member.

5. The system of claim 2, wherein the image bearing member rotates and the mechanism is controlled to selectively control the positioning corresponding to rotation of the first and second regions of the image bearing member.

6. The system of claim 1, wherein the first charging device is configured to contact the first region of the image bearing member.

7. The system of claim 6, wherein the second charging device is configured to contact the second region of the image bearing member, the second charging device further configured to not charge the first region of the image bearing member.

8. The system of claim 1, wherein the second charging device is configured to provide a clearance between the second charging device and the second region of the image bearing member.

9. The system of claim 1, wherein the second region comprises a seam region of a photoconductive material of the image bearing member, and the seam region corresponds to a non-imaging area of the image bearing member.

10. The system of claim 9, wherein the seam region is formed by a layer of photoconductive material.

11. The system of claim 1, wherein the second region has smaller radius compared to the first region.

12. The system of claim 1, wherein the second region has greater radius compared to the first region.

13. The system of claim 1, wherein the system comprises a liquid electrophotography charging system.

14. An electrophotography charging system, comprising:

first and second charging devices for charging a first region and a second region, respectively, of a photoconductor of a hard imaging device;

the first charging device configured to be positioned during hard imaging operations using the hard imaging device wherein the first charging device does not substantially charge the second region;

the second charging device configured to be positioned during hard imaging operations using the hard imaging device wherein the second charging device does not substantially charge the first region; and wherein the first and second regions of the photoconductor extend substantially an entirety of an axial length of a photoconductive surface of the photoconductor.

15. The system of claim 14, wherein the first charging device is configured to contact the first region, and the second charging device is configured to contact the second region.

16. The system of claim 14, further comprising:

a mechanism to selectively control actuation of the first and the second charging devices to control a clearance between the first and second charging devices and the photoconductor, respectively.

17. The system of claim 14, wherein the first region comprises an imaging region of the photoconductor and the second region comprises a non-imaging region of the photoconductor.

18. The system of claim 14, wherein the first region comprises a non-seam region of the photoconductor, and the second region comprises a seam region of the photoconductor.

19. The system of claim 14 wherein the photoconductor comprises a cylindrical member and the first and second regions comprise regions of different radii of the cylindrical member.

20. An electrophotography charging system, comprising:

a first charging device configured to charge a non-seam region of a photoconductor of a hard imaging device; and a second charging device configured to charge a seam region of the photoconductor, and wherein the first charging device is configured to provide a clearance between the first charging device and the seam region during hard imaging operations using the hard imaging device, and the second charging device is configured to provide a clearance between the second charging device and the non-seam region during hard imaging operations using the hard imaging device, wherein the second charging device does not substantially charge the non-seam region.

21. The system of claim 20, further comprising:

a mechanism for controlling actuation of a select one of the first and second charging devices to control the clearance between the select one of first and second charging devices and the photoconductor, and wherein the first and second regions comprise different radii from a central axis of the photoconductor.

22. The system of claim 20, further comprising:

a mechanism for controlling actuation of both the first and second charging devices to control the clearance between the first and second charging devices and the photoconductor, and wherein the first and second regions comprise same radii from a central axis of the photoconductor.

23. A hard imaging apparatus comprising:

a cylindrical image bearing member;

a scanning device configured to scan an image onto the image bearing member;

a charging system comprising:

a first charging member configured to charge a respective first region of the image bearing member to form latent images during hard imaging operations of the hard imaging apparatus; and a second charging member configured to charge a second region of the image bearing member during hard imaging operations of the hard imaging apparatus; and a mechanism configured to selectively maintain a clearance between the first and second charging members and the image bearing member.

24. The apparatus of claim 23, wherein the first and second regions comprise different radii from a central axis of the image bearing member.

25. The apparatus of claim 23, wherein the first and second regions comprise same radii from a central axis of the image bearing member.

26. The apparatus of claim 23 wherein the mechanism is configured to maintain the clearance to substantially preclude charging of the second region by the first charging member and to substantially preclude charging of the first region by the second charging member.

27. The apparatus of claim 23 further comprising a developer configured to provide a liquid developing agent to the image bearing member to develop the latent images.

28. An electrophotoraphy charging system comprising:

a first means for charging a first region of a rotating photoconductor;

a second means for charging a second region comprising a seam of the rotating photoconductor; and wherein both the first and second regions rotate adjacent to the first and second means and the first means comprises means for charging only the first region, and the second means comprises means for charging only the second region, and wherein the second region is a seam of a photoconductive surface of the photoconductor.

29. A hard imaging device electrophotography charging method comprising:

charging a first region of a photoconductor using a first charging device, the first region of the photoconductor used to form latent images during hard imaging operations of the hard imaging device; and charging a second region of the photoconductor using a second charging device, wherein the first and second charging devices comprise different charging devices individually configured to charge the respective first and second regions of the photoconductor having different radii.

30. The method of claim 29, wherein charging the first region comprises charging an imaging region of the photoconductor of the hard imaging device, and the charging the second region comprises charging a non-imaging region of the photoconductor.

31. The method of claim 29, further comprising:

arranging the first charging device to contact the first region while providing a clearance between the first charging device and the second region of the photoconductor; and arranging the second charging device to contact the second region while providing a clearance between the second charging device and the first region of the photoconductor.

32. The method of claim 29, further comprising:

arranging the first charging device to provide a first clearance between the first charging device and the first region of the photoconductor to charge the first region, and a second clearance between the first charging device and the second region of the photoconductor to avoid charging the second region.

33. The method of claim 29, further comprising:

arranging the second charging device to provide a first clearance between the second region of the photoconductor and the second charging device to charge the second region, and a second clearance between the first region of the photoconductor and the second charging device to avoid charging the first region.

34. The method of claim 29, wherein the first charging device only charges the first region, and the second charging device only charges the second region.

35. The method of claim 29, wherein the charging of the first and second regions comprises moving the respective first and second charging devices towards the photoconductor.

36. The method of claim 32, wherein the moving comprises actively moving using an actuator.

37. The method of claim 35, wherein the moving comprises passively moving without an actuator.

38. The method of claim 29, further comprising:

configuring the first and second charging devices with respective first and second sets of drive members;

configuring the photoconductor to have end members; and configuring the end members to have a plurality of contour paths of differing radii measured from a central axis of the end members, wherein the first and second sets of drive members are configured to ride on select contour paths of the end members to maintain predetermined positions of the first and second charging devices relative to the photoconductor.

39. A hard imaging apparatus comprising:

an image bearing member;

a first charge roller configured to charge a first region of the image bearing member during hard imaging operations of the hard imaging apparatus;

a second charge roller configured to charge a second region of the image bearing member during the hard imaging operations of the hard imaging apparatus;

a scanning device configured to discharge portions of the charged image bearing member to form latent images;

a developer configured to apply a developing agent to develop the latent images formed on the image bearing member during hard imaging operations of the hard imaging apparatus; and a system configured to control movement of at least one of the first charge roller and the second charge roller in a radial direction with respect to the image bearing member.

40. The apparatus of claim 39, wherein the second region comprises a different radius compared to the first region of the image bearing member, the radii of the first and second regions measured from a central axis of the image bearing member.

41. The apparatus of claim 39 wherein the developer is configured to apply the developing agent comprising a liquid developing agent.

42. An electrophotography charging system, comprising:

first and second charging devices for charging a first region and a second region, respectively, of a photoconductor of a hard imaging device;

the first charging device configured to be positioned during hard imaging operations using the hard imaging device wherein the first charging device does not substantially charge the second region;

the second charging device configured to be positioned during hard imaging operations using the hard imaging device wherein the second charging device does not substantially charge the first region; and a mechanism to selectively control actuation of the first and the second charging devices to control a clearance between the first and second charging devices and the photoconductor, respectively.

43. An electrophotography charging system, comprising:

first and second charging devices for charging a first region and a second region, respectively, of a photoconductor of a hard imaging device;

the first charging device configured to be positioned during hard imaging operations using the hard imaging device wherein the first charging device does not substantially charge the second region;

the second charging device configured to be positioned during hard imaging operations using the hard imaging device wherein the second charging device does not substantially charge the first region; and wherein the first region comprises a non-seam region of the photoconductor, and the second region comprises a seam region of the photoconductor.

44. A hard imaging device electrophotography charging method comprising:

charging a first region of a photoconductor using a first charging device, the first region of the photoconductor used to form latent images during hard imaging operations of the hard imaging device;

charging a second region of the photoconductor using a second charging device, wherein the first and second charging devices comprise different charging devices individually configured to charge the respective regions of the photoconductor;

arranging the first charging device to contact the first region while providing a clearance between the first charging device and the second region of the photoconductor; and arranging the second charging device to contact the second region while providing a clearance between the second charging device and the first region of the photoconductor.

45. A hard imaging device electrophotography charging method comprising:

charging a first region of a photoconductor using a first charging device, the first region of the photoconductor used to form latent images during hard imaging operations of the hard imaging device;

charging a second region of the photoconductor using a second charging device, wherein the first and second charging devices comprise different charging devices individually configured to charge the respective regions of the photoconductor; and arranging the first charging device to provide a first clearance between the first charging device and the first region of the photoconductor to charge the first region, and a second clearance between the first charging device and the second region of the photoconductor to avoid charging the second region.

46. The method of claim 45 further comprising arranging the second charging device to provide a first clearance between the second region of the photoconductor and the second charging device to charge the second region, and a second clearance between the first region of the photoconductor and the second charging device to avoid charging the first region.

47. A hard imaging device electrophotography charging method comprising:

charging a first region of a photoconductor using a first charging device, the first region of the photoconductor used to form latent images during hard imaging operations of the hard imaging device;

charging a second region of the photoconductor using a second charging device, wherein the first and second charging devices comprise different charging devices individually configured to charge the respective regions of the photoconductor; and wherein the charging of the first and second regions comprises moving the respective first and second charging devices towards the photoconductor.

48. The method of claim 47 wherein the moving comprises actively moving using an actuator.

49. The method of claim 47 wherein the moving comprises passively moving without an actuator.

50. A hard imaging device electrophotography charging method comprising:

charging a first region of a photoconductor using a first charging device, the first region of the photoconductor used to form latent images during hard imaging operations of the hard imaging device;

charging a second region of the photoconductor using a second charging device, wherein the first and second charging devices comprise different charging devices individually configured to charge the respective regions of the photoconductor;

configuring the first and second charging devices with respective first and second sets of drive members;

configuring the photoconductor to have end members; and configuring the end members to have a plurality of contour paths of differing radii measured from a central axis of the end members, wherein the first and second sets of drive members are configured to ride on select contour paths of the end members to maintain predetermined positions of the first and second charging devices relative to the photoconductor.

51. A hard imaging apparatus comprising:

an image bearing member;

a charge roller configured to charge the image bearing member during hard imaging operations of the hard imaging apparatus;

a scanning device configured to discharge portions of the charged image bearing member to form latent images:

a developer configured to apply a liquid developing agent to develop the latent images formed on the image bearing member during hard imaging operations of the hard imaging apparatus;

wherein the charge roller comprises a first charge roller configured to charge a first region of the image bearing member, and further comprising a second charge roller configured to charge a second region of the image bearing member during the hard imaging operations of the hard imaging apparatus; and wherein the second region comprises a different radius compared to the first region of the image bearing member, the radii of the first and second regions measured from a central axis of the image bearing member.

* * * * *